US009169454B2

(12) United States Patent
Nacson

(10) Patent No.: US 9,169,454 B2
(45) Date of Patent: Oct. 27, 2015

(54) LUBRICATING OIL FORMULATION

(76) Inventor: Sabatino Nacson, Thornhill (CA)

( * ) Notice: Subject to any disclaimer, the term of this patent is extended or adjusted under 35 U.S.C. 154(b) by 464 days.

(21) Appl. No.: 13/590,789

(22) Filed: Aug. 21, 2012

(65) Prior Publication Data

US 2013/0053290 A1 Feb. 28, 2013

Related U.S. Application Data

(60) Provisional application No. 61/527,486, filed on Aug. 25, 2011.

(51) Int. Cl.

| | |
|---|---|
| ***C10M 169/04*** | (2006.01) |
| ***C10M 159/08*** | (2006.01) |
| ***C10M 129/06*** | (2006.01) |
| ***C10M 131/04*** | (2006.01) |

(52) U.S. Cl.

CPC ..... *C10M 169/04* (2013.01); *C10M 2203/06* (2013.01); *C10M 2203/10* (2013.01); *C10M 2203/1006* (2013.01); *C10M 2207/021* (2013.01); *C10M 2207/0215* (2013.01); *C10M 2207/40* (2013.01); *C10M 2207/401* (2013.01); *C10M 2207/402* (2013.01); *C10M 2211/022* (2013.01); *C10M 2211/0225* (2013.01); *C10N 2230/04* (2013.01); *C10N 2230/06* (2013.01); *C10N 2230/08* (2013.01); *C10N 2230/10* (2013.01); *C10N 2230/24* (2013.01); *C10N 2230/36* (2013.01); *C10N 2240/10* (2013.01)

(58) Field of Classification Search

CPC ..... C10M 169/04; C10M 2203/06; C10M 2203/10; C10M 2203/1006; C10M 2207/021; C10M 2207/0215; C10M 2207/40; C10M 2207/401; C10M 2207/402; C10M 2211/022; C10M 2211/0225; C10N 2230/04; C10N 2230/06; C10N 2230/08; C10N 2230/10; C10N 2230/24; C10N 2230/36; C10N 2240/10

USPC ..... 508/365, 532, 577, 589

See application file for complete search history.

(56) References Cited

U.S. PATENT DOCUMENTS

| | | | | |
|---|---|---|---|---|
| 4,131,551 | A | 12/1978 | Thompson | |
| 4,178,258 | A | 12/1979 | Papay et al. | |
| 4,228,021 | A | 10/1980 | Lenack | |
| 4,289,634 | A * | 9/1981 | Lewis et al. | 508/436 |
| 4,360,438 | A | 11/1982 | Rowan et al. | |
| 4,844,825 | A | 7/1989 | Sloan et al. | |
| 4,846,983 | A | 7/1989 | Ward, Jr. | |
| 5,744,430 | A | 4/1998 | Inoue et al. | |
| 6,855,675 | B1 | 2/2005 | Yamada et al. | |
| 6,884,761 | B2 | 4/2005 | Godici et al. | |
| 2002/0002118 | A1 * | 1/2002 | Brandt | 508/378 |
| 2002/0042348 | A1 * | 4/2002 | McNeil et al. | 508/118 |
| 2008/0295391 | A1 * | 12/2008 | Ritter et al. | 44/308 |
| 2008/0312115 | A1 * | 12/2008 | Ribeaud | 508/272 |

* cited by examiner

*Primary Examiner* — James Goloboy

(57) ABSTRACT

A lubricating oil formulation particularly useful in an internal combustion engine, comprising hydrofine paraffinic distillate from 10-30% v/v, castor/linseed oil from 5 to 40% v/v, aliphatic alcohol from 10-20% v/v and chlorinated paraffin from 10-30% v/v.

8 Claims, No Drawings

LUBRICATING OIL FORMULATION

CROSS-REFERENCE TO RELATED APPLICATIONS

This application claims the benefit of U.S. Provisional Application No. 61/527,486 filed Aug. 25, 2011, incorporated herein by reference in its entirety.

FIELD OF THE INVENTION

The invention relates generally to the field of lubrication, and more generally, to the field of lubricating oil formulations.

BACKGROUND OF THE INVENTION

A typical lubricating oil formulation (e.g. standard motor oil) has lubrication as its primary function, but it also performs a number of other functions that are vital to the life and performance of fuel combustion engine. For example, in applications such as the internal combustion engine ("ICE") oil dissipates heat and makes parts run cooler; it helps to reduce engine noise; it combats rust and corrosion of metal surfaces; it acts as a seal for pistons, rings, and cylinder walls; it combines with the oil filter to remove foreign substances from the engine.

When combustion occurs, temperatures can reach 2000-3000° F. (1093-1648° C.), while pistons can easily reach a temperature of 1000° F. (537° C.). The high heat load travels down the connecting rods to the bearings. Oil in the crankcase can reach 250° F. (121° C.) after warm-up and is supplied to the bearings at these temperatures.

There are a number of patent and non-patent references that describe the current state of the art of lubricating oil formulations. These include:

| | | |
|---|---|---|
| U.S. Pat. No. 4,178,258 | December, 1979 | Papay et al. |
| U.S. Pat. No. 4,360,438 | November, 1982 | Rown et al. |
| U.S. Pat. No. 4,846,983 | July, 1989 | Ward, Jr. |
| U.S. Pat. No. 5,744,430 | April, 1998 | Inoue et al. |
| U.S. Pat. No. 6,855,675 | February, 2005 | Yamada, et al. |
| U.S. Pat. No. 6,884,761 | April, 2005 | Godici, et al. |
| U.S. Pat. No. 4,844,825 | November, 1987 | Sloan, et al. |
| U.S. Pat. No. 4,131,551 | December, 1978 | Thompson |
| U.S. Pat. No. 4,228,021 | October, 1980 | Lenack |

Synthetics, Mineral Oils, and Bio-Based Lubricants, Leslie R. Rudnick, CRC Press, 2005.

Synthetic Lubricants and High Performance Functional Fluids. Leslie R. Rudnick and Ronald L. Subkin, CRC Press 1999.

Chemistry and Technology of Lubricants, R. M. Mortier, S. T. Orzulik, Springer 1997.

SUMMARY OF THE INVENTION

What is desired is a lubricating oil formulation showing improvement in at least one of the following areas: lubricating power, oxidation resistance, non-toxicity, boundary lubrication, friction modification, cooling and engine wall protection.

Therefore, according to the invention, there is provided a lubricating oil formulation comprising the following components: (1) hydrofine paraffinic distillate in an amount 10%-30% v/v; (2) castor oil in an amount 0%-40% v/v; (3) linseed oil in an amount 0%-40% v/v; (4) aliphatic alcohol in an amount 10%-20% v/v; and (5) chlorinated paraffin in an amount 10%-30% v/v; wherein the component (2) and the component (3) together are present in an amount 5%-40% v/v.

DETAILED DESCRIPTION OF THE PREFERRED EMBODIMENTS

In the preferred embodiment, the lubricating oil formulation comprises the following components: (1) hydrofine paraffinic distillate in an amount 10%-30% v/v; (2) castor oil in an amount 0%-40% v/v; (3) linseed oil in an amount 0%-40% v/v; (4) aliphatic alcohol in an amount 10%-20% v/v; and (5) chlorinated paraffin in an amount 10%-30% v/v; wherein the component (2) and the component (3) together are present in an amount 5%-40% v/v. In other words, the amount of component (2), added to the amount of component (3), is 5%-40% of the formulation v/v. Preferably, the castor oil and linseed oil are present in a 1:1 ratio (by volume). The following table shows three example formulations:

| Component | % Example 1 | % Example 2 | % Example 3 |
|---|---|---|---|
| Hydrofine Paraffinic distillate | 20 | 30 | 30 |
| Castor oil | 20 | 20 | 15 |
| Linseed oil | 20 | 20 | 15 |
| Aliphatic alcohol | 20 | 20 | 20 |
| Chlorinated paraffin | 20 | 10 | 20 |

Regarding the castor oil and linseed oil components, it will be appreciated that the polarity of ester molecules and acidic oils causes them to be attracted to one another and to other polar species, which has a direct impact on their performance. These substances exhibit low vapour pressures, low volatilities and high flash point. Because of their polar nature, they are excellent solvents, and are attracted to metal oxide layers on the surfaces of ICEs and the like, making them good boundary lubricants and friction modifiers. These molecules also have ester linkage with excellent thermal stability and resistance to oxygen molecule attack under relatively high temperatures. They also have low viscosity, and high viscosity indices.

Typical properties of these molecules are:

| | |
|---|---|
| Viscosity at 40° C. (cst) | 4-30 |
| Viscosity at 100° C. (cst) | 1-6 |
| Viscosity Index | 150-230 |
| Pour Point (° C.) | −35 to +25 |
| Flash point (° C.) | 180-220 |
| Oxidative Stability | Good |
| Biodegradability | Excellent |

Their small sizes, combined with high polarities, make them effective solvents. Blending them with poly olefins (e.g. hydrofine paraffinic distillate) improves solubility and causes the blend to act as a seal swelling agent. Specifically, the blend diffuses into the elastomer of seals in ICEs, causing moderate expansion that improves seal performance. As well, castor and linseed oil molecules, having a high polarity and thus a higher affinity for metal oxide surfaces, have a greater tendency than less polar fluids (like mineral oils or synthetic hydrocarbons) to form adsorbed layers. Thus, castor and linseed oil have lower boundary friction coefficients. In the preferred formulation, the polar head of these molecules is anchored to the metal of surface of the ICE or other lubricated object, while the hydrocarbon tail is left solubilized in the lubricating oil formulation.

A benefit of the preferred form of the lubricating oil formulation is that it does not impede the functionality of elastomers with which it comes in contact. Thus, it does not make the elastomers soluble and prone to breakdown or loss of functionality, either by shrinkage or over-swelling.

In one embodiment, the castor oil component comprises 87%-90% ricinoleic acid w/w, 5%-7% oleic acid w/w, 1%-3% linoleic acid w/w, 1%-2% palmitic acid w/w and 1% stearic acid w/w. In one embodiment, the linseed oil component comprises of 6% palmitic acid w/w, 3.5% stearic acid w/w, 0.5% arachidic acid w/w, 19% oleic acid w/w, 24% linoleic acid w/w, 47% linolenic acid w/w.

The presence of paraffin oils (e.g. hydrofine paraffinic distillate) in combination with polar based oils (such as castor and linseed oils) offers greater oxidation resistance, reduced carbon sludge, effective operation at high temperatures, increased lubricity, higher film strength and consequently, reduced wear friction. These paraffin oils compliment the natural fatty acids in the polar oils by increasing the viscosity index of the lubricating oil formulation. Also, paraffinic oils are generally more compatible with elastomers and seals, and offer greater resistance to water emulsification (e.g. if water were to undesirably enter into an ICE). It has been found that hydrofine paraffinic distillates sold under the FAXAM 22™ trademark are well-suited for use in the formulation.

Preferably, the chlorinated paraffin ranges from $C_5$ to $C_{20}$. This component serves as a lubricant additive to improve the performance of the lubricating oil formulation under extreme pressure in an ICE or the like. Preferably, the chlorinated paraffin component comprises mixed chlorinated paraffins blended in mineral oil, which improves the shelf life of this component. Cereclor™ brand has been found to be well-suited for use in this formulation, and its typical properties are as follows:

| | Grade | | | |
|---|---|---|---|---|
| | A | B | C | D |
| Chlorine (% wt) | 40 | 42 | 48 | 49 |
| Density @25° C. | 1.11 | 1.16 | 1.24 | 1.19 |
| Viscosity @25° C. (poise) | 0.7 | 25 | 280 | 0.8 |
| Viscosity @100° C. (cS) | 4 | 32 | 70 | 4 |
| Pour Point Approx. ° C. | −40 | −30 | −15 | −30 |
| Stability 4 hour @175° C. (% HCl released) | 0.2 | 0.2 | 0.2 | 0.15 |

Regarding the aliphatic alcohol component of the formulation, it has been found that Exxal™ brand, produced by Exxon Mobil, is well-suited for use in this formulation. Typical properties of aliphatic alcohols are:

| Type | Boiling point ° C. | Specific Gravity @20° C. | Viscosity @ 20° C. cSt | Vapor pressure @100° C. | Flash point ° C. | Pour Point ° C. |
|---|---|---|---|---|---|---|
| Exxal 7 | 176 | 0.826 | 9.2 | 78 mmHg | >60 | <−65 |
| Exxal 8 | 193 | 0.833 | 13 | 27 | >60 | <−65 |
| Exxal 9 | 215 | 0.836 | 17 | 16 | >60 | <−65 |
| Exxal 10 | 224 | 0.838 | 21 | 8 | >93 | <−65 |
| Exxal 12 | 254 | 0.844 | 38 | 5 | >93 | <−65 |
| Exxal 13 | 266 | 0.848 | 49 | 3 | >93 | <−65 |

Aliphatic alcohol is added as an antioxidant, metal scavenger, anti-foaming agent and emulsion stabilizer. It also acts as a solvent with lubricating properties.

Optionally, the formulation may include one or more alkyl benzenes, such as xylene or toluene, in an amount 0.1%-1% v/v. It has been found that this additive functions to reduce soot buildup inside the combustion chamber of the ICE, and clean engine cylinders and surrounding surfaces.

It will be appreciated that regarding the percent ranges given in relation to any component or ingredient, the component or ingredient may be present in any specific amount falling within that range, or within any sub-range falling within that range.

The invention claimed is:

1. A lubricating oil formulation comprising the following components: (1) hydrofine paraffinic distillate in an amount 10%-30% v/v; (2) castor oil in an amount 0%-40% v/v; (3) linseed oil in an amount 0%-40% v/v; (4) aliphatic alcohol in an amount 10%-20% v/v; and (5) chlorinated paraffin in an amount 10%-30% v/v; wherein the formulation includes both component (2) and the component (3), present in a total amount 5%-40% v/v.

2. A lubricating oil formulation, wherein the chlorinated paraffin component comprises mixed chlorinated paraffins from $C_5$ to $C_{20}$.

3. A lubricating oil formulation of claim 1, wherein the castor oil and linseed oil are present in a 1:1 ratio by volume.

4. A lubricating oil formulation as claimed in claim 1, wherein the castor oil component comprises 87%-90% ricinoleic acid w/w, 5%-7% oleic acid w/w, 1%-3% linoleic acid w/w, 1%-2% palmitic acid w/w and 1% stearic acid w/w.

5. A lubricating oil formulation as claimed in claim 1, wherein the linseed oil component comprises of 6% palmitic acid w/w, 3.5% stearic acid w/w, 0.5% arachidic acid w/w, 19% oleic acid w/w, 24% linoleic acid w/w, 47% linolenic acid w/w.

6. A lubricating oil formulation as claimed in claim 1, the formulation further comprising one or more alkyl benzenes in an amount of 0.1%-1% v/v.

7. A lubricating oil formulation as claimed in claim 6, where the one or more alkyl benzenes comprise xylene, toluene, or a combination thereof.

8. A lubricating oil formulation as claimed in claim 1, wherein the aliphatic alcohol comprises aliphatic alcohol having a viscosity of 49 cSt at 20° C.

* * * * *